US010418014B2

(12) United States Patent
Lowry et al.

(10) Patent No.: US 10,418,014 B2
(45) Date of Patent: Sep. 17, 2019

(54) SOUND REDUCING SHROUD

(71) Applicant: Sonoco Development, Inc., Hartsville, SC (US)

(72) Inventors: James Lowry, Franklin, TN (US); Kirk Valko, Dundee, IL (US)

(73) Assignee: Sonoco Development, Inc., Hartsville, SC (US)

( * ) Notice: Subject to any disclaimer, the term of this patent is extended or adjusted under 35 U.S.C. 154(b) by 255 days.

(21) Appl. No.: 15/583,260

(22) Filed: May 1, 2017

(65) Prior Publication Data

US 2018/0268797 A1 Sep. 20, 2018

Related U.S. Application Data

(60) Provisional application No. 62/471,121, filed on Mar. 14, 2017.

(51) Int. Cl.
*G10K 11/00* (2006.01)

(52) U.S. Cl.
CPC ..... *G10K 11/002* (2013.01)

(58) Field of Classification Search
CPC ..... G10K 11/002
USPC ..... 181/202, 198
See application file for complete search history.

(56) References Cited

U.S. PATENT DOCUMENTS

| | | | | |
|---|---|---|---|---|
| 4,258,821 | A | 3/1981 | Wendt et al. | |
| 5,272,285 | A * | 12/1993 | Miller | F04B 39/0033 181/202 |
| 6,722,466 | B1 | 4/2004 | Tong et al. | |
| 6,766,879 | B2 * | 7/2004 | Eilers | A47J 42/38 181/198 |
| 6,875,066 | B2 | 4/2005 | Wolaver | |
| 7,398,855 | B2 * | 7/2008 | Seel | F01C 21/10 181/200 |
| 7,874,400 | B2 | 1/2011 | Teisseyre | |
| 2005/0056481 | A1 * | 3/2005 | Mafi | F24F 1/12 181/202 |
| 2008/0099275 | A1 * | 5/2008 | Seel | F04B 39/0033 181/202 |

* cited by examiner

*Primary Examiner* — Forrest M Phillips
(74) *Attorney, Agent, or Firm* — Miller, Matthias & Hull LLP

(57) ABSTRACT

A sound reducing shroud for use with an appliance or other machine is provided. The shroud comprises a body made from foam. The body has a sidewall having a discontinuous circumference, a first vertical end and an opposing second vertical end. The body can be resiliently flexible so that the body is re-configurable between an open position in which the first vertical end and the second vertical end are spread apart to accommodate installation of the shroud around the machine, and a closed position in which the first vertical end and the second vertical end mate to form a seam. Alternatively, the body can comprise a first half shell and a second half shell that fit together to make a shroud around the machine. The first half shell and the second half shell can be designed to snap fit together, or can be held together using fasteners or strapping.

17 Claims, 4 Drawing Sheets

SOUND REDUCING SHROUD

BACKGROUND OF THE INVENTION

Field of the Invention

This disclosure relates to a sound reducing device for use with an appliance or other machine. More particularly, this disclosure relates to a one-piece or multiple piece foam shroud for use in dampening sound emanating from an appliance or other machine.

Description of the Related Art

Noisy motors, pumps and compressors that are part of appliances or other machines can be a noise distraction and audio irritant. A number of attempts have been made to address this problem.

For example, Wendt U.S. Pat. No. 4,258,821 discloses a sound-absorbent shroud for a blower. The shroud is provided with a slit which can be ponded to facilitate installation.

Tong U.S. Pat. No. 6,722,466 discloses an acoustic blanket for a machine. The blanket comprises flexible panels connected by tie rods.

Wolaver U.S. Pat. No. 6,875,066 discloses a multiple piece shroud for an outboard motor. The shroud comprises molded flexible sections have an outer surface shaped complementary to the inner surface of the outboard cover.

Teisseyre U.S. Pat. No. 7,874,400 discloses a noise isolation device for a swimming pool pump. The device comprises multiple panels of sound absorbing material and a plurality of fasteners built into the panels for assembling the panels to form an enclosure.

None of the prior art references discloses a simple, molded, flexible contoured sound reducing shroud that can be easily installed around a machine. The present disclosure addresses this need.

BRIEF SUMMARY OF THE INVENTION

The present disclosure relates to a sound reducing device for use with an appliance or other machine such as a garbage disposal.

In one aspect the disclosure relates to a shroud comprising a body. The body has an interior surface, a sidewall having a discontinuous circumference and a vertically oriented spine. The body also has a first vertical end and an opposing second vertical end configured to mate to form a vertical seam circumferentially opposite the spine. The body is resiliently flexible along the spine so that the body is re-configurable between an open position in which the first vertical end and the second vertical end are spread apart to accommodate installation of the shroud around the machine and a closed position in which the first vertical end and the second vertical end mate to form the seam.

In another aspect the disclosure relates to a sound reducing shroud comprising a first half shell and a second half shell. The first half shell comprises a first side wall portion, a first top wall portion and a first base portion and is contoured to conform substantially to the shape of a portion of the machine. Portions of the first side wall portion, the first top wall portion and the first base portion form a first mating surface. The first mating surface defines a groove. The second half shell comprises a second side wall portion, a second top wall portion and a second base portion and is contoured to conform substantially to the shape of a remaining portion of the machine. Portions of the second side wall portion, the second top wall portion and the second base portion form a second mating surface. The second mating surface comprises a flange that is configured to fit within the groove to form a seam when the first half shell and the second half shell are fitted together.

DETAILED DESCRIPTION OF THE INVENTION

Figure 1:
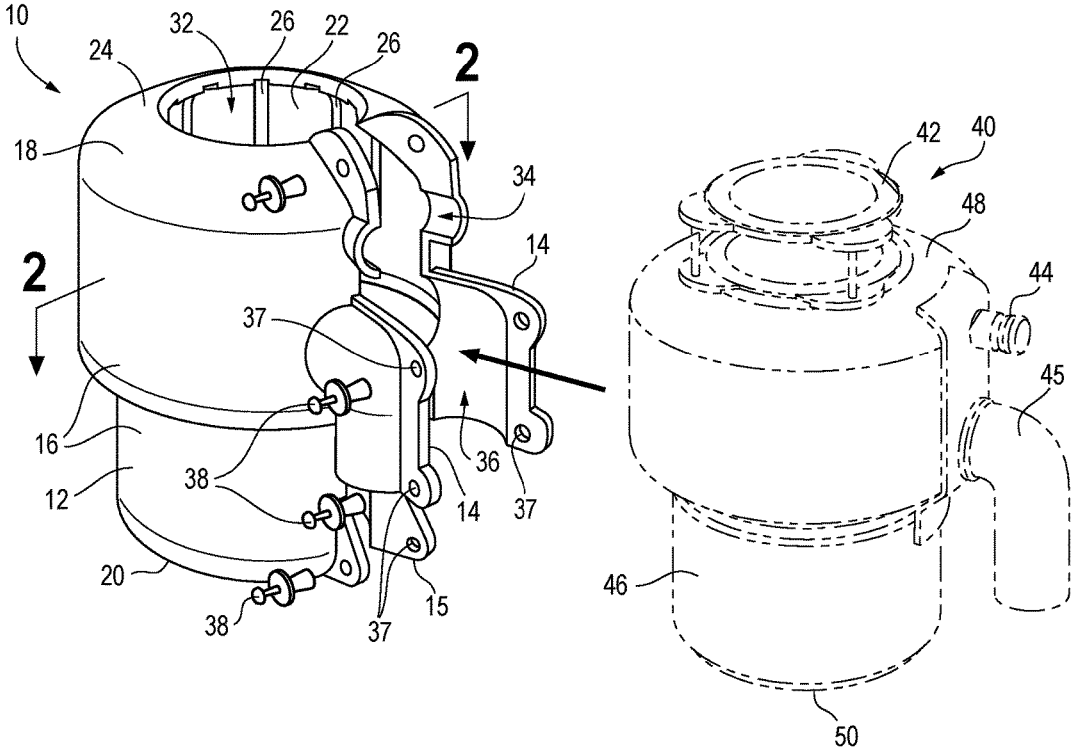
FIG. 1 is a perspective view of a shroud for a machine such as a garbage disposal, shown before installation.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

Figure 2:
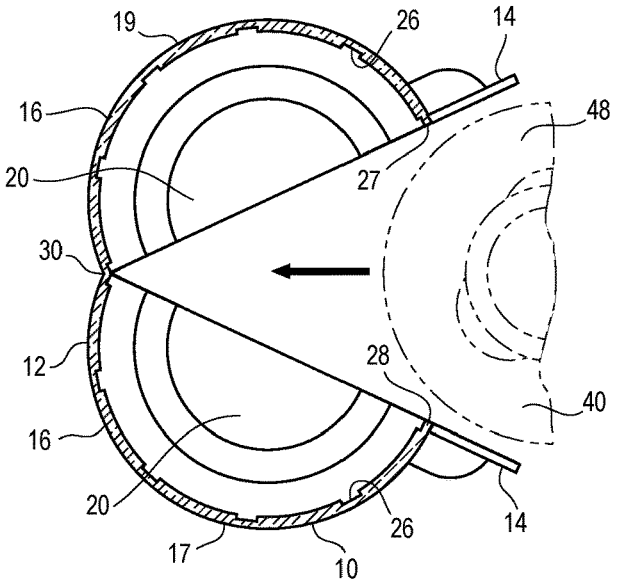
FIG. 2 is a top down cross-sectional view of the shroud of FIG. 1 taken along line 2-2 showing the shroud in an open configuration, ready to receive a machine.

As will be appreciated, terms such as "above" and "below", "upper" and "lower", "top" and "bottom," "front" and "back," (etc.), used as nouns, adjectives or adverbs refer in this description to the orientation of the shroud as it is illustrated in the various views. For example, "top wall" refers to the top wall of the shroud as seen in FIGS. 1 and 2. Such terms are not intended to limit the invention to a particular orientation.

Turning to the drawings, where like numerals indicate like elements, there is shown in FIG. 1 one embodiment of the present invention, a shroud 10 for a machine. The shroud 10 functions to reduce sound emanating from the machine.

FIG. 1 is a perspective view of the shroud 10 and a machine 40 before installation of the shroud 10 around the machine 40. The machine in this instance is a garbage disposal. The shroud 10 comprises a body 12 that may conform substantially to the shape of the machine 40. For example, in the illustrated embodiment, the shroud 10 is used with a garbage disposal 40 having a substantially cylindrical sidewall 46, a domed top wall 48 and a bottom wall 50. Accordingly, the shroud body 12 also has a roughly cylindrical sidewall 16, a domed top wall 18 and a bottom wall 20. The shroud sidewall 16 extends between the top wall 18 and the bottom wall 20. The top wall 18 may define a top opening 32 for accommodating structures that are part of the garbage disposal 40 or other structures.

FIG. 2 is a top down cross-sectional view of the shroud 10 of FIG. 1 taken along line 2-2 showing the shroud 10 before installation. The body 12 may assume a clamshell type design having a vertically oriented living hinge. Alternatively, instead of a living hinge, the body 12 may be sufficiently flexible along a vertically oriented spine 30 and a seam 29 so that the body 12 can be opened (spread apart) along the seam 29 to allow the shroud 10 to be installed around the machine 40.

The body 12 may comprise a first half shell 17 and a second half shell 19 joined along the spine 30. The first half shell 17 may extend circumferentially away from the spine 30 and may terminate at a first mating surface 27 substantially opposite the spine 30. The second half shell 19 may extend circumferentially away from the spine 30 in the opposite direction of the first half shell 17 and may terminate at a second mating surface 28 substantially opposite the spine 30. Together, the first half shell 17 and the second half shell 19 may extend 360 degrees to fully or almost fully encompass a machine 40.

The body 12 may have a first mating surface 27 and a second mating surface 28 that mate when the shroud 10 is installed to form the seam 29. The seam 29 may be circumferentially opposite the spine 30.

The spine 30 may extend vertically along the sidewall 16 and may extend along the top wall 18 and the bottom wall 20 so that when the body 12 is opened, the first mating surface 27 and the second mating surface 28 are spread apart a sufficient distance to allow the shroud 10 to be installed around the machine 40, that is, a distance greater than the circumference of the machine 40.

The body 12 has an interior surface 22 and an exterior surface 24; both may be shaped substantially like the exterior surface of the machine 40. The interior surface 22 may define channels for allowing air movement around the machine 40, such as the vertical channels 26 arranged circumferentially around the interior surface 22 of the shroud 10 shown in FIG. 1.

Figure 3:
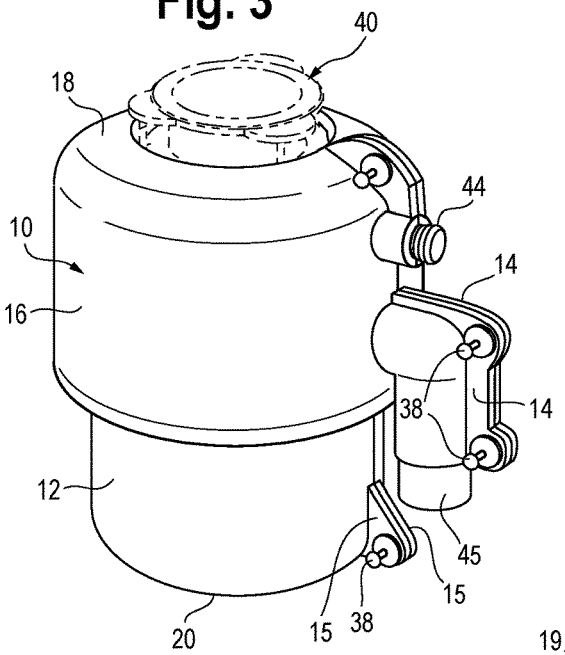
FIG. 3 is a perspective view of the shroud of FIG. 1 shown after installation.
Figure 4:
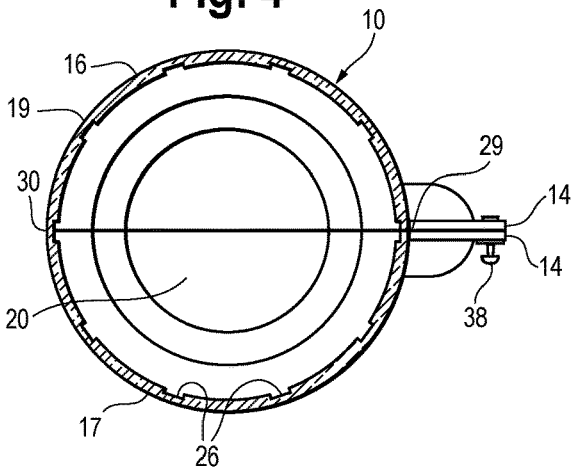
FIG. 4 is a top down cross-sectional view of the shroud of FIG. 3, shown without the machine for clarity.

FIG. 3 is a perspective view of the shroud 10 after installation around a machine 40. FIG. 4 is a cross-sectional view of the shroud 10 of FIG. 1. After being installed around the machine 40, the body 12 assumes its original closed configuration with the first mating surface 27 and the second mating surface 28 forming the seam 29.

The first half shell 17 and the second half shell 19 may be held shut in any suitable fashion. For example, a closure flange 14 may extend laterally outwardly from the first half shell 17 near the first mating surface 27, and another closure flange 14 may extend laterally outward from the second half shell 19 near the second mating surface 28. The closure flanges 14 may mate to form a seal and may define co-linear apertures 37 for accommodating fasteners 38 such as rivets or bolts. In similar fashion, second closure flanges 15 may extend outwardly from the first half shell 17 and the second half shell 19 and may also define apertures 37 for accommodating fasteners 38.

Alternatively, the first mating surface 27 and the second mating surface 28 may be held together in tongue and groove fashion as illustrated with respect to a second embodiment below. For example, the first mating surface 17 may define a groove that extends along some or all of the first mating surface 27. The second mating surface 28 may comprise a tongue or tongue 92 that is configured to fit within the groove when the first half shell 17 and second half shell 19 are fitted together to form the shroud 10.

As noted above, the body 12 may define one or more openings for accommodating parts of the machine 40 or conduits and other structures connected to the machine 40. For example, in the illustrated embodiment, the top wall 18 of the body 12 defines a top opening 32 for accommodating a top mounting structure 42 of the garbage disposal. The sidewall 16 defines a first side opening 34 for accommodating a dishwater drain hose connection 44 and a second side opening 36 for accommodating a sewage hose connection 45. Of course, the shroud 10 may have many other configurations that define different openings depending on the machine whose sound is being suppressed.

The shroud 10 may be a single unitary molded piece. The shroud 10 may be made of any suitable resilient foam or foam-like moldable material such as expanded polypropylene (EPP). The material may also be porous to allow higher sound absorption into body 12.

The shroud may be made in the following manner. As a first step, a mold is prepared having interior contours similar to the exterior contours of a machine 40. In a second step a molded foam shroud body 12 substantially as described above is formed in the mold. In a third step the shroud body is peeled from the mold, wherein the molded foam is flexible enough to allow for removal of the molded part without damaging the intended shape.

Figure 5:
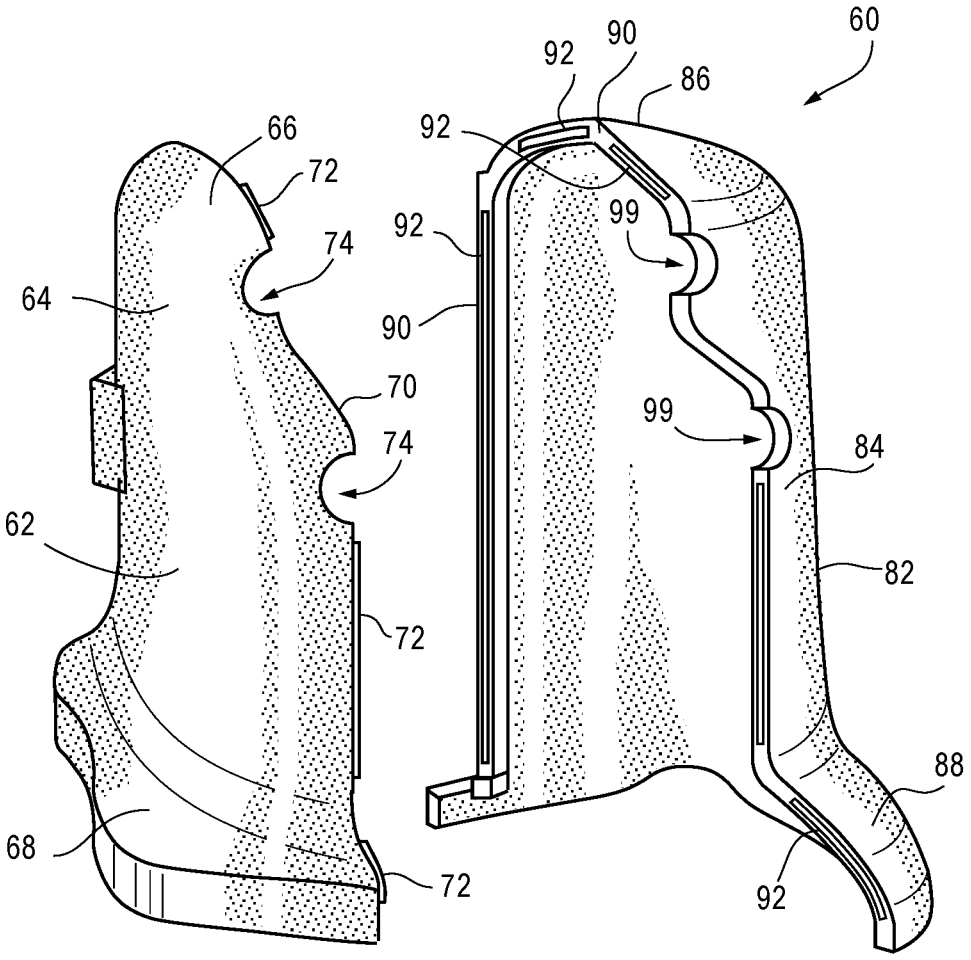
FIG. 5 is a perspective view of an alternative shroud before assembly.

FIG. 5 is a perspective view of an alternative shroud 60. Like the previous embodiment, the shroud 60 comprises a first half shell 62 and a second half shell 82, except in this embodiment the first half shell 62 and the second half shell 82 are separate structures. The shroud 60 may be used for any suitable machine 40, such as a compressor found in a refrigeration unit or in a heat and air condition compressor.

The first half shell 62 may comprise a first side wall portion 64, a first top wall portion 66 and a first base portion 68. The first side wall portion 64, the first top wall portion 66 and the first base portion 68 may form one continuous first half shell 62 and may be contoured to conform substantially to the shape of a portion of the machine (not shown) for which the shroud 60 will be used. Portions of the first side wall portion 64, the first top wall portion 66 and the first base portion 68 together form a first mating surface 70.

Similarly, the second half shell 82 may comprise a second side wall portion 84, a second top wall portion 86 and a second base portion 88. The second side wall portion 84, the second top wall portion 86 and the second base portion 88 may form one continuous second half shell 82 and may be contoured to conform substantially to the shape of a portion of the machine (not shown) for which the shroud 60 will be used. Portions of the second side wall portion 84, the second top wall portion 86 and the second base portion 88 together form a second mating surface 90.

The first half shell 62 and the second half shell 82 may be held together in any suitable fashion. For example, the first mating surface may define a groove 72. The groove 72 may extend along some or all of the first mating surface 70 and may be continuous or discontinuous. The second mating surface 90 may comprise an outwardly extending tongue 92 that is configured to fit within the groove 72 when the first half shell 62 and second half shell 82 are fitted together to form the shroud 60. The tongue 92 may extend along some or all of the second mating surface 90 and may be continuous or discontinuous. The groove 72 and the tongue 92 are co-extensive, and may be either continuous or, as shown in FIG. 5, discontinuous.

Alternatively, as described above with respect to the previous embodiment, one or more first closure flanges (not shown) may extend laterally outward from the first half shell 62 near the first mating surface 70, and an equal number of second closure flanges may extend laterally outwardly from the second half shell 82 near the second mating surface 90. The first and second closure flanges may define co-linear apertures for accommodating fasteners such as rivets or bolts.

Figure 6:
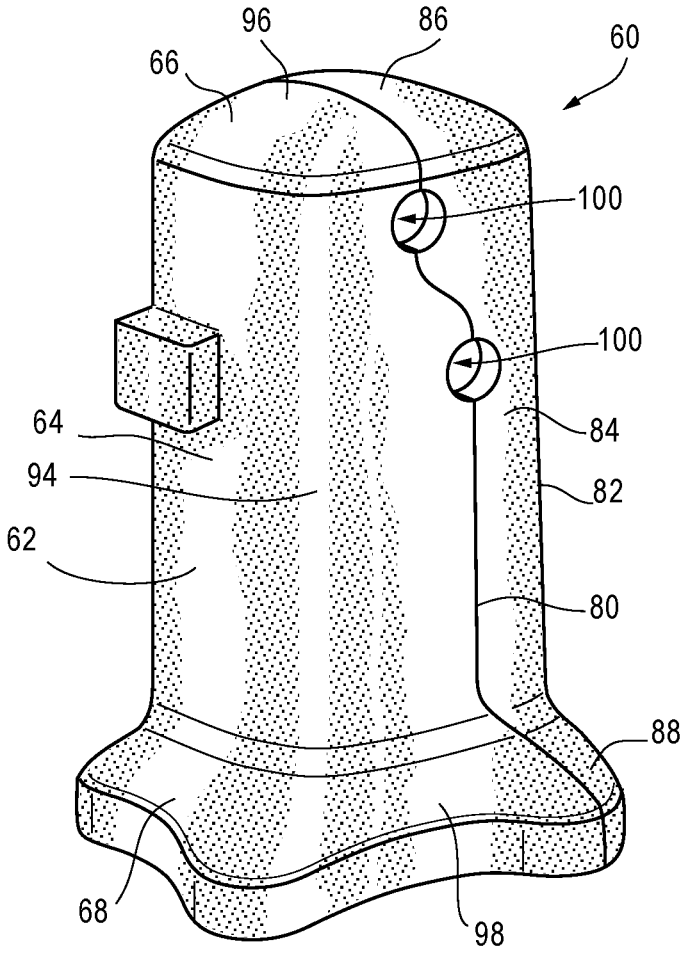
FIG. 6 is a perspective view of the shroud of FIG. 5 after assembly.

FIG. 6 is a perspective view of the shroud 60 of FIG. 5 after assembly. The first half shell 62 and the second half shell 82 have been brought together so that the first mating surface 70 mates with the second mating surface 90 to form a seam 80 and the tongues 92 are disposed within the grooves 72. The first side wall portion 64 and the second side wall portion 84 form a complete 360 degree side wall 94 that surrounds the machine. The first top wall portion 66 and the second top wall portion 86 form a top wall 96 that covers all or some of the top of the machine. The first base portion 68 and the second base portion 88 form a base 98 which may surround the base of the machine and which may be enlarged beyond the contours of the machine inside to provide stability to the shroud 60 and machine assembly.

The shroud 60 may conform substantially to the shape of the machine for which it is to be used. The shroud 60 may define one or more openings 100 for accommodating structures that are part of the machine. More particularly, the first shell half 62 defines a first part 74 of each opening 100 and the second shell half 82 defines the remaining part 99 of each opening 100.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A sound reducing shroud for a machine, the machine having a shape, the shroud comprising:

a body comprising a first half shell and a second half shell hingedly joined along a vertical spine, the first half shell extending circumferentially from the spine to a first mating surface, the second half shell extending circumferentially from the spine to a second mating surface; the body having an interior surface and a sidewall having a discontinuous circumference, the first mating surface and the second mating surface configured to mate to form a vertical seam; wherein the body is resiliently flexible so that the body is reconfigurable between an open position in which the first mating surface and the second mating surface are spread apart to accommodate installation of the shroud around the machine and a closed position in which the first mating surface and the second mating surface mate to form the seam;

the shroud further comprises a first closure flange extending laterally outwardly from the first mating surface and a second closure flange extending laterally outwardly from the second mating surface, the closure flanges defining apertures for accommodating fasteners; and the closure flanges are circumferentially opposite the spine.

2. The shroud of claim 1 wherein:

the body defines one or more openings for accommodating structures that are part of or connected to the machine.

3. The shroud of claim 2 wherein:

the machine is a garbage disposal having a substantially cylindrical sidewall, a domed top wall and a bottom wall; and the shroud body has a substantially cylindrical sidewall, a domed top wall and a bottom wall, the shroud sidewall extending between the top wall and the bottom wall.

4. The shroud of claim 3 wherein:

the body top wall defines a top opening for accommodating a top mounting structure of the garbage disposal; and the body sidewall defines a first side opening for accommodating a dishwater drain hose connection and a second side opening for accommodating a sewage hose connection.

5. The shroud of claim 1 wherein:

the shroud is a single unitary molded piece.

6. The shroud of claim 5 wherein:

the shroud is made of a foam or foam-like moldable material.

7. The shroud of claim 6 wherein:

the shroud is made of expanded polypropylene.

8. The shroud of claim 7 wherein:

the shroud is porous to allow higher sound absorption into the body.

9. The shroud of claim 1 wherein:

the interior surface defines a plurality of air flow channels.

10. The shroud of claim 1 wherein:

the channels are arranged circumferentially around the interior surface of the shroud.

11. The shroud of claim 1 wherein:

the interior surface conforms substantially to the shape of the machine.

12. A sound reducing shroud for a machine, the machine having a shape, the shroud comprising:

a first half shell comprising a first side wall portion, a first top wall portion and a first base portion and contoured to conform substantially to the shape of a portion of the machine, portions of the first side wall portion, the first top wall portion and the first base portion forming a first mating surface, the first mating surface defining a groove;

a second half shell comprising a second side wall portion, a second top wall portion and a second base portion and contoured to conform substantially to the shape of a remaining portion of the machine, portions of the second side wall portion, the second top wall portion and the second base portion forming a second mating surface, the second mating surface comprising a tongue that is configured to fit within the groove to form a seam when the first half shell and second half shell are fitted together; wherein the first half shell and the second half shell are separate structures; and the groove of the first half shell and the tongue of the second half shell form a snap fit.

13. The shroud of claim 12 wherein:

the shroud defines one or more openings for accommodating structures that are part of or connected to the machine.

14. The shroud of claim 13 wherein:

the first shell half defines a first part of each opening and the second shell half defines a remaining part of each opening.

15. The shroud of claim 12 wherein:

the groove and the tongue are co-extensive.

16. The shroud of claim 12 wherein:

the groove and the tongue are both discontinuous.

17. The shroud of claim 12 wherein:

the shroud is made of expanded polypropylene.

* * * * *